US005313174A

United States Patent [19]

Edwards

[11] Patent Number: 5,313,174

[45] Date of Patent: May 17, 1994

[54] 2:1 BANDWIDTH, 4-WAY, COMBINER/SPLITTER

[75] Inventor: Richard C. Edwards, Cedar Rapids, Iowa

[73] Assignee: Rockwell International Corporation, Seal Beach, Calif.

[21] Appl. No.: 947,860

[22] Filed: Sep. 18, 1992

[51] Int. Cl.[5] ..... H01P 5/12

[52] U.S. Cl. ..... 333/109; 333/116; 333/128; 333/161

[58] Field of Search ..... 333/109, 116, 128, 161, 333/115, 127; 330/124 R, 295

[56] References Cited

U.S. PATENT DOCUMENTS 3,988,705 10/1976 Drapac ..... 333/109
4,549,152 10/1985 Kumar ..... 330/295 X
5,126,704 6/1992 Dittmer et al. ..... 333/128 X

*Primary Examiner*—Paul Gensler
*Attorney, Agent, or Firm*—Kyle Eppele; M. Lee Murrah; H. Fredrick Hamann

[57] ABSTRACT

A four way 2:1 bandwidth RF splitter/combiner is described. When used as a splitter, the splitter/combiner provides equal amplitude output signals while maintaining quadrature phase over the entire bandwidth of the input signal. This splitter/combiner also maintains a one to one VSWR and eliminates back door intermodulation. When used as a combiner, the splitter/combiner losslessly combines four equal amplitude quadrature phase signals.

8 Claims, 4 Drawing Sheets

2:1 BANDWIDTH, 4-WAY, COMBINER/SPLITTER

INCORPORATION BY REFERENCE

U.S. Pat. No. 3,988,705, entitled "Balanced 4-Way Power Divider Employing 3 DB 90° Couplers", inventor Michael J. Drapac; and Chapter 13 of Microwave Filters, Impedance Matching Networks and Coupling Structures by Matthaei, Young, and Jones, are incorporated by reference herein.

BACKGROUND OF THE INVENTION a. Technical Field

The present invention pertains to electrical power splitters or combiners. More particularly, the invention pertains to splitters or combiners which operate to split or combine 2:1 bandwidth RF signals. Because a splitter of the present invention may be operated as a combiner, in which case the splitter outputs become combiner inputs and the splitter input becomes a combiner output, when the following discussion refers to a splitter of the present invention the discussion also implicitly refers to a combiner.

b. Problems in the Art

Electrical signals often must be divided and/or combined. For example, the power output requirements for an RF signal ma exceed the capability of readily available RF amplifiers; and to produce the required power output, the RF signal is divided and delivered to multiple amplifiers. The amplifiers' outputs are then combined to provide a power output which none of the amplifiers could have produced individually.

Quadrature hybrid couplers (couplers) are often used in power splitters. The couplers have two inputs and two outputs, one of which inputs is connected to a termination resistance matched to the system characteristic impedance (typically 50 ohms for RF signal applications). By terminating this input in this fashion, reflections at the other input are eliminated and a one-to-one VSWR is maintained. Applying a signal to the other input of the coupler produces signals at the two outputs of the coupler, each of which contains approximately half the power from the input signal.

At one output, the 0° or AC-coupled output, the phase relative to the input signal is 0° and at the other output, the −90° or DC-coupled output, the relative phase is 90°, which is inherently characteristic of a 3 db 90° coupler. Additionally, although nominally half the power is delivered to each output, the amplitude response of the coupler varies according to the frequency of the input. That is, the outputs do not each have exactly one-half the power of the input signal. The frequency-dependent amplitude characteristics of the coupler outputs are illustrated in FIG. 3 of the appended drawings. Notice that one output contains more than half the input signal and the other output, complementarily, less than half the input over a frequency range of operation. This imbalance at the outputs is typically no greater than ±0.4 db at most. The 0° output will typically have a maximum amplitude output of −2.6 db located at the center frequency, and the −90° output normally has a minimum amplitude output of −3.4 db at the center frequency.

When one coupler drives two other couplers, thereby creating a four-way power divider, the imbalance at the four outputs of the two driven couplers is typically ±0.8 db. Two of the outputs are normally balanced at approximately −6.0 db (¼ the input power), but the other two outputs are unbalanced. One output is typically at −5.2 db and the other output is at −6.8 db (in contrast to the nominal, desired −6.0 db).

If these divided signals were then sent to four amplifiers for amplification, one of the amplifiers would be presented a signal at approximately −5.2 db; that is approximately 30 % of the input signal power, rather than the desired 25 %. Because it is best to use identical amplifiers, each amplifier would have to be sized to handle 30 % of the input signal value. This requirement obviously limits amplifier selection, requires greater amplifier capacity, and reduces reliability due to the fact that one amplifier is carrying an excess burden that should, ideally, be shared among four amplifiers. This amplitude imbalance and its concomitant demands on amplifier capacity, reduced selection, and reduced reliability is the major shortcoming of prior art splitters.

Adding a fourth coupler (see FIG. 4), balances the two unbalanced outputs, thereby solving the amplitude imbalance problem of the prior art four-way splitter. Unfortunately, there are phase errors associated with this solution which, until the present, have never been addressed. These phase errors contribute to amplitude errors which are significant enough to negate the amplitude enhancement when the four amplified signals are recombined.

It is therefore an object of the present invention to provide a new and improved splitter which exhibits no amplitude imbalance at the output of the splitters, while, at the same time, eliminating phase errors which have heretofore cancelled the beneficial effects of a four-coupler splitter. These and other objects, features, and advantages of the present invention will become apparent from the specification and claims.

SUMMARY OF THE INVENTION

To eliminate the phase problem alluded to above, the phase transfer characteristics from the input to each of the four splitter outputs must differ by 90° (quadrature phase). In addition to resolving the phase-induced amplitude imbalance, the quadrature phase relationship also assures (assuming the use of identical amplifiers) an input.VSWR of one-to-one and cancellation of back door intermodulation products.

The splitter of the present invention produces a quadrature phase relationship among the four splitter outputs which provides a balanced amplitude splitter output, eliminates phase-induced imbalance in the combiner, assures an input VSWR of one-to-one, and cancels back door intermodulation products. This is all accomplished by incorporating into the design transmission line phase compensation networks which may be located on the sam printed wiring board (PWB) as the quadrature hybrid couplers. A complete four-way coupler, including the phase compensation network, can be fabricated on a single PWB by using meandering strip lines. For example, when operated as a splitter, the present invention employs three 3 db 90° couplers to split the input signal into four approximately equal amplitude signals. However, two of the four outputs are unbalanced by as much as 0.4 db. The two unbalanced outputs are fed to a fourth 3 db coupler which produces two outputs of very nearly equal amplitude. At this point, after passing the signal through four 3 db couplers, the amplitude of each of the outputs would be very nearly the same ($<<0.5$ db difference) but for the phase-induced errors. The phase relationship among the signals is not the quadrature phase relationship required for proper recombination after amplification. The present invention therefore incorporates transmission lines of various electrical length to impart the correct phase relationship among the divided signals. Further, because the addition of the transmission lines assures quadrature only at the center frequency of the signal, the signals are then fed through equalization networks consisting of 3 db 90° couplers and fixed electrical length transmission lines. The equalization networks preserve the quadrature phase relationship over the 2:1 bandwidth of the input signal.

When operated as a combiner, the present invention accepts quadrature phase, equal-amplitude signals such as would be generated by the present invention operated as a splitter and, due to reciprocity, combines the four approximately equal-amplitude quadrature phase signals in an optimum fashion.

When operated as a splitter/amplifier/combiner, one of the splitter/combiners of the present invention is used to split an input signal into four approximately equal-amplitude quadrature phase output signals. The outputs of the splitter are fed to four approximately identical amplifiers and the amplified outputs from those amplifiers are then fed to a splitter/combiner of the present invention which combines the four inputs. Thus, an output signal with four times the power of each of the amplified signals is provided at the output of the splitter/combiner operating as a combiner.

DETAILED DESCRIPTION OF THE PREFERRED EMBODIMENT

Figure 1:
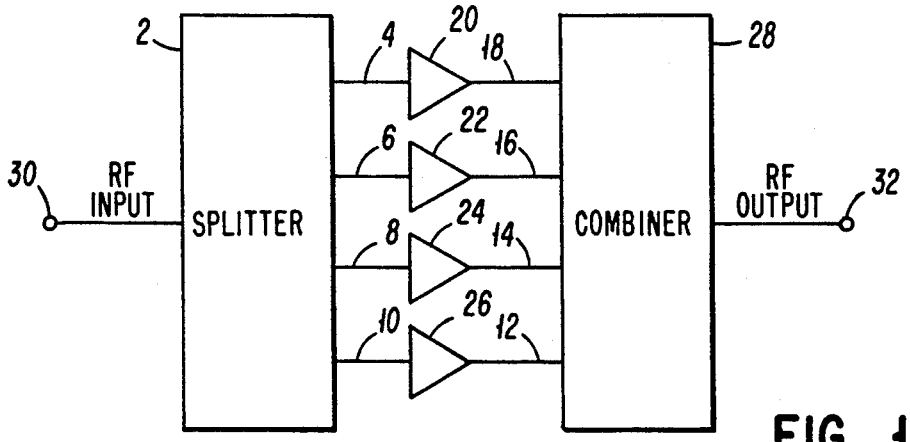
FIG. 1 is a general block diagram of a splitter/amplifier/combiner combination used to amplify an RF signal.

To assist in a better understanding of the present invention, a specific embodiment of the invention will now be set forth in detail. This description is not inclusive of all forms the invention can take, but is illustrative only.

Reference characters used throughout this description including numbers, letters, and combinations of the same refer to the appended drawings and are used to indicate specific parts or locations in the drawings. The same reference characters will be used for the same parts and locations throughout all the drawings unless otherwise indicated.

FIG. 1 illustrates a basic splitter/amplifier/combiner configuration as practiced in the prior art and, in general terms, as practiced with the present invention. In normal operation an RF signal is presented to the input of a splitter 2 which, ideally, splits the input RF signal into equal components. That is, signals having one-fourth the input power of the input RF signal are presented at outputs 4, 6, 8 and 10 of splitter 2. After being split in this way, the input RF signal is amplified by amplifiers 20, 22, 24 and 26. After amplification, the amplified signals are presented to inputs 18, 16, 14 and 12 of combiner 28. Combiner 28 then combines the amplified RF signals and presents a combined signal at output 32, which is the input signal amplified by four times the capability of any individual amplifier. The motivation for using such a splitter/amplifier/combiner configuration is that none of the amplifiers 20, 22, 24 or 26 has the capability of providing the magnitude of output power required at output 32. By splitting input 30 into equal parts, amplifying those parts by amplifiers 20, 22, 24, and 26, then combining those amplified signals with combiner 28, the RF power requirements at output 32 are satisfied.

Figure 2:
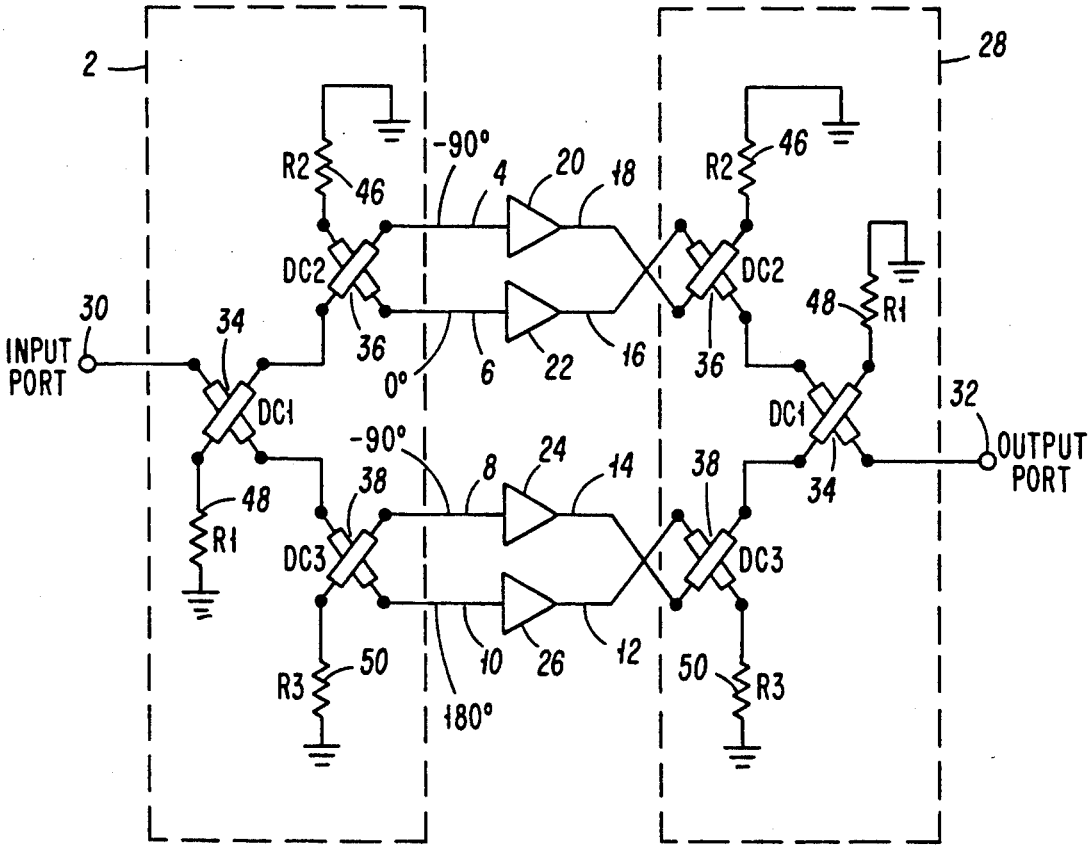
PRIOR ART FIG. 2
FIG. 2 is a more detailed illustration of a prior art splitter/amplifier/combiner combination of FIG. 1.

FIG. 2 illustrates a well known realization of the device of FIG. 1 for moderate bandwidths (e.g., 225–400 Mhz). In this configuration, the input power through input port 30 is split in half by the input quadrature hybrid coupler 34, and the remaining two couplers, 36 and 38, split the power further (ideally into four equal parts) to the four outputs 4, 6, 8, and 10. Resistors 46, 48, and 50 are dump resistors with values equal to port normalization impedance, $Z_0$. These resistors absorb power only if the output ports' 4, 6, 8, and 10 termination impedance is not equal to $Z_o$. See Chapter 13 of the Matthaei, Young, and Jones incorporated by reference.

Figure 3:
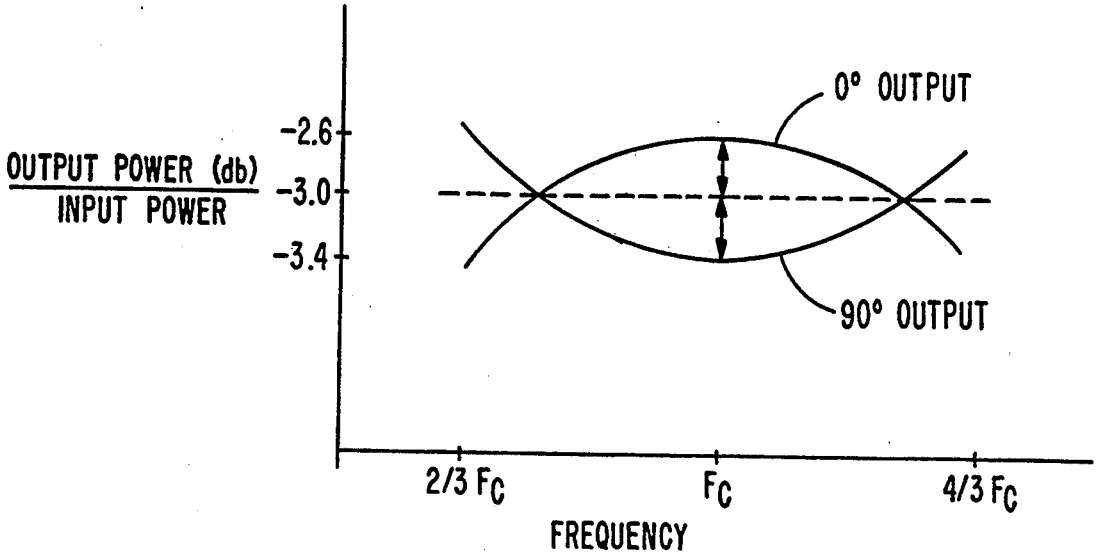
FIG. 3 illustrates input/output power transfer characteristics as a function of frequency for a typical quadrature coupler.

The phase and amplitude relationships between an input to any of the couplers 36, 34 or 38 and their outputs is determined by the characteristic curves illustrated in FIG. 3. The relative phase between the input and one coupler output is 90° while the output has a relative phase of 0° . The 90° output transfers slightly less than the desired one-half of the input power while the 0° output transfers slightly more than half the input power at the center frequency.

As can be seen from FIG. 3, this power transfer relationship is frequency dependent. The 0° output has an excess of nearly 0.4 db at the center frequency, trailing off at the frequency extremes. The 90° output is 3.4 db down at the center frequency but tracks up to a nominal 3 db toward either end of the 2:1 bandwidth. Note too how these offsets from the ideal 3 db division between the two outputs are complementary.

Based on the phase and amplitude relationships illustrated in FIG. 3 for an individual coupler, it can be seen that the phase relationships between ports 4, 6, 8, and 10 and the input port 30 in FIG. 2 are −90°, 0°, −90° and −180°, respectively. This quadrature phasing of the signals presented to the amplifiers is necessary to keep the splitter input VSWR at a one-to-one ratio when loaded by identical amplifiers whose input impedances vary with frequency. Quadrature phasing also provides complete cancellation of back door intermodulation components (assuming identical amplifier nonlinearities).

The inherent problem with the prior art splitter 2 shown in FIG. 2, is excessive amplitude imbalance at outputs 4, 6, 8, and 10. For example, for a 2:1 bandwidth design, the amplitude variation at outputs 6 and 10 is +0.8 and −0.8 db, respectively. Consequently, at certain frequencies one amplifier supplies a disproportionate amount of the required output power. As a result, the reliability of that amplifier is reduced, and the overall system design must be derated accordingly in order to accommodate the peak loading of this amplifier. Furthermore, because of increased power requirements on the overloaded amplifier, and its consequent temperature cycling, the reliability, not only of the amplifier, but also of the printed wiring board and surrounding components are reduced.

Figure 4:
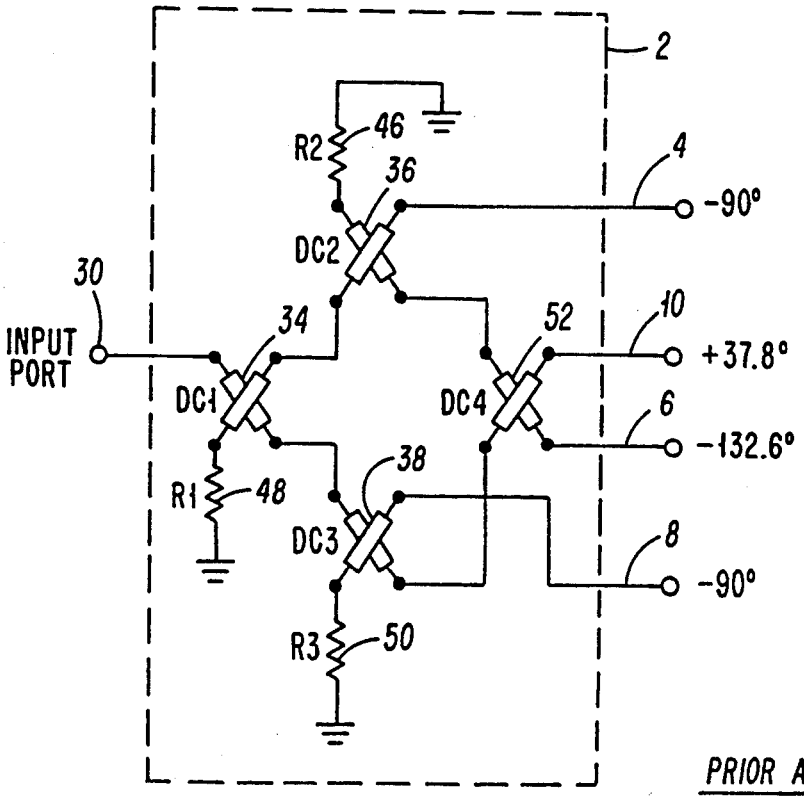
PRIOR ART FIG. 4
FIG. 4 is a schematic depiction of the four-coupler configuration of Drapac U.S. Pat. No. 3,988,705.

The splitter of another prior art circuit is shown in FIG. 4. The circuit is created by adding coupler 52 to combine the two output ports 6 and 10 which exhibit extremes in excursion from ideal amplitude coupler characteristics as mentioned above. Outputs 6 and 10 are exceptionally flat because coupler 52, by combining the outputs of coupler 36 and coupler 38, cancels the undesirable amplitude variations.

Although the addition of a fourth coupler flattens the amplitude at outputs 6 and 10, the relative phase is, as shown in FIG. 4, −90°, 37.8°, −132.6°, and −90° at outputs 4, 10, 6 and 8 respectively. That is, the outputs are no longer in quadrature. Consequently, when an attempt is made to recombine these signals (after amplification), the phase relationship will negate the beneficial effects of the added fourth coupler. Power will be poured into the combiner's dump resistors, and the imbalance at the inputs to the amplifiers (outputs 4, 6, 8 and 10) will force derating of the splitter/amplifier/-combiner design.

Figure 5:
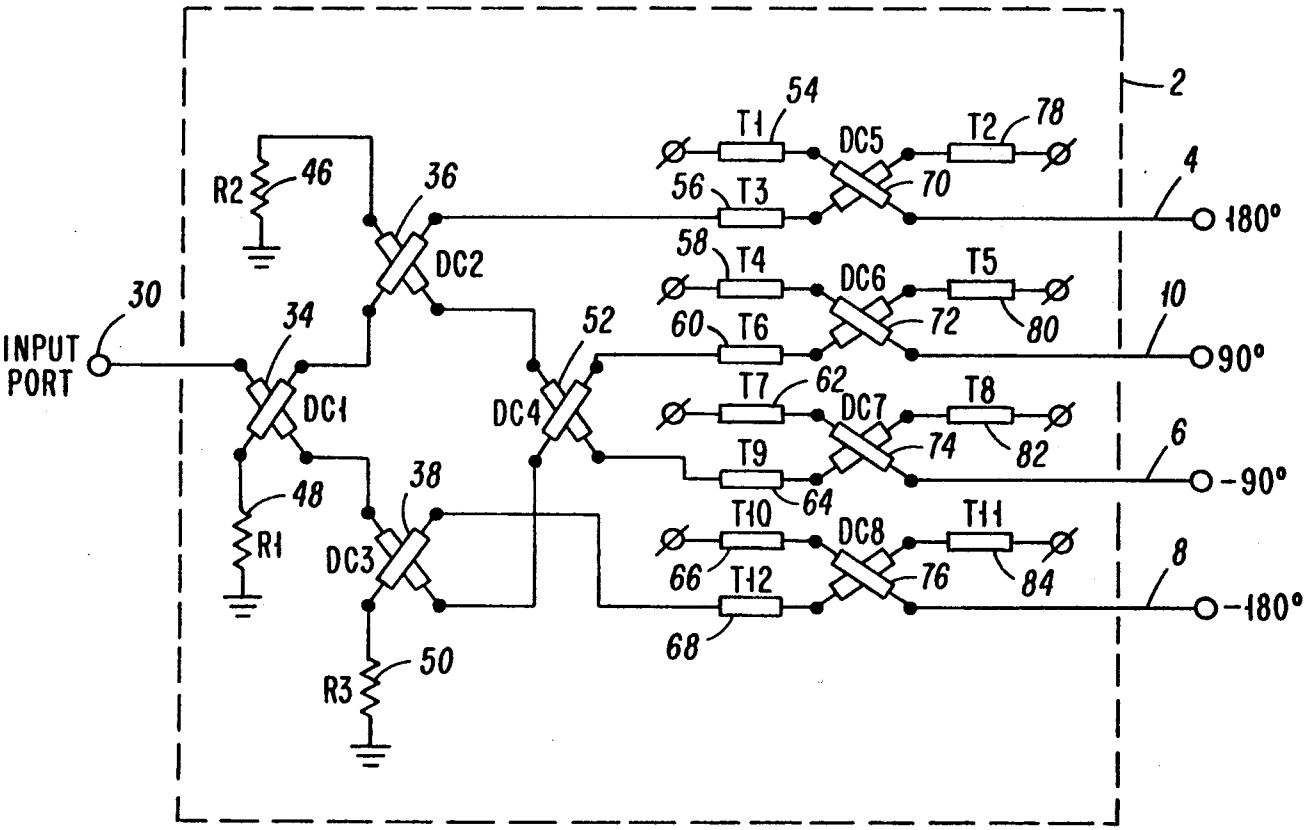
FIG. 5 is an electrical schematic of the present invention.

Recognizing the failings of the 4-coupler design, the preferred embodiment of the present invention, illustrated in FIG. 5, restores the desired quadrature phase relationship within 5° over bandwidths not exceeding 2:1.

The lengths of transmission lines 56, 60, 64, and 68 are chosen to reestablish the quadrature phase relationship at the center frequency. The resultant center frequency phase shifts corresponding to electrical line lengths of 180°, 37.8°, 47.4°, and 180°, are: −90°+180°=90°, 37.8°−37.8°=0°, −132.6°−47.4°=−180°, and −90°=180°=90°, respectively.

Transmission lines, of course, can take many forms. Any number of conductor/dielectric combinations can exhibit identical transmission line characteristics. The salient characteristic for purposes of the present invention is that the delay time, or phase shift, of a transmission line is determined by the electrical length of the line (the speed of electromagnetic wave propagation in a transmission line with a dielectric constant greater than one is lower than that of a wave in free space). Thus, transmission lines generate a signal delay relative to free space. In addition, of course, the characteristic impedance of the transmission line must be correct (e.g., 50 ohms for the design example shown in Table 1 below.)

TABLE 1

Component Values for the Improved 2:1 Bandwidth, 4-way Combiner Splitter

| Component | Zo (Ohms) | Electrical Length (deg) | Stripline Conductor Width (mils) |
|---|---|---|---|
| T1 | 36.3 | 90.0 | 122.0 * |
| T2 | 36.3 | 90.0 | 122.0 * |
| T3 | 50.0 | 180.0 | 76.2 * |
| T4 | 50.7 | 90.0 | 74.5 * |
| T5 | 50.7 | 90.0 | 74.5 * |
| T6 | 50.0 | 37.8 | 76.2 * |
| T7 | 61.0 | 90.0 | 54.4 * |
| T8 | 61.0 | 90.0 | 54.4 * |
| T9 | 50.0 | 47.4 | 76.2 * |
| T10 | 36.3 | 90.0 | 122.0 * |
| T11 | 36.3 | 90.0 | 122.0 * |
| T12 | 50.0 | 180.0 | 76.2 * |
| Component | | Resistance (Ohms) | |
| R1 | | 50.0 | |
| R2 | | 50.0 | |
| R3 | | 50.0 | |

TABLE 1-continued

Broadside Stripline Coupler

| Component | Z-even (ohms) | Z-odd (ohms) | Conductor Width (mils) | Distance Between Conductors (mils) |
|---|---|---|---|---|
| DC1-DC8 | 128.3 | 19.48 | 35.8 * | 7.8 * |

Where:
$Z_{even}$ = Even Mode Impedance of the Directional Coupler
$Z_{odd}$ = Odd Mode Impedance of the Directional Coupler The electrical length of all directional couplers is 90° at the arithmetic center of the frequency band.
* For the example stripline realization:
Dielectric constant = 2.3
Dielectric thickness = 100.0 mils The electrical length of all directional couplers is 90° at the arithmetic center of the frequency band. * For the example stripline realization:

Dielectric constant =2.3

Dielectric thickness =100.0 mils

Although transmission lines 56, 60, 64 and 68 establish the desired quadrature relationship at the center frequency, they cannot provide phase equalization over the 2:1 bandwidth of the input signal frequency.

Therefore, the output of transmission lines 56, 60, 64, and 68 are connected to phase equalizers consisting of couplers 70, 72, 74, and 76 with their associated open circuit transmission line pairs. For example, transmission line 56 connects to coupler 70 with its open circuit transmission line 54 and 78.

Each phase equalizer presents a 90° phase shift at the center frequency with a rate of phase change dependent upon the characteristic impedance of the open circuit transmission line pairs. So, the final center frequency phase shifts at the four outputs 4, 10, 6, and 8 are: 90°+90°=180°, 0°+90°=90°, −180°+90°=−90°, and 90°+90°=180°, respectively. Moreover, the relative quadrature phase errors between the four outputs is less than ±5° for the entire 2:1 bandwidth if the proper transmission line impedance as given in Table 1 are used.

Values for transmission lines T1 through T12 are given in Table 1. The impedance and electrical length values are invariant with frequency, and, in general, can be used in conjunction with 2:1 bandwidth signals. By way of example, conductor widths for a strip line implementation are also listed in Table 1.

Figure 6:
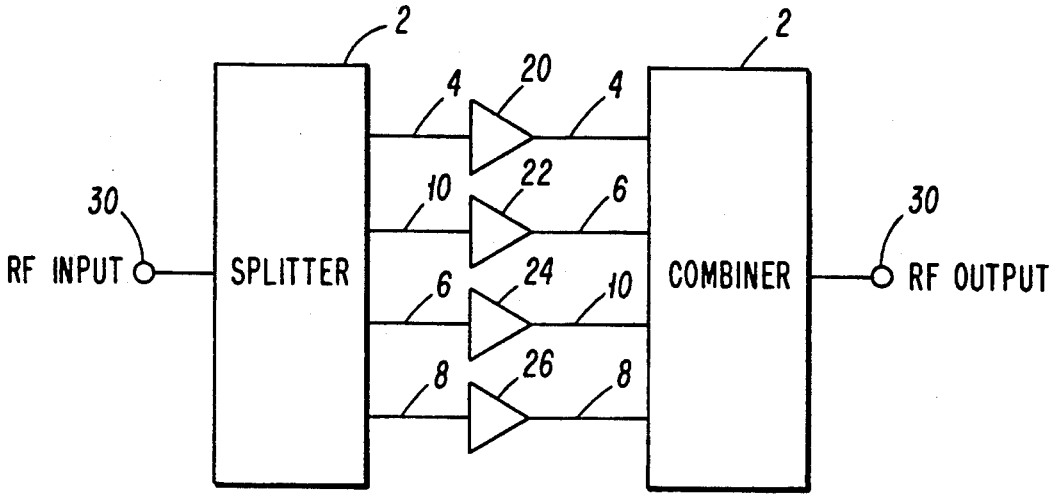
FIG. 6 is an illustration of a splitter/amplifier/combiner utilizing two splitters of the present invention.

In an amplification application, the splitter of the present invention would be configured as illustrated in FIG. 6. In the figure, one of the splitters acts as a splitter, and another acts as a combiner. In general, the splitter/amplifier/combiner combination operates as the combination of FIG. 1. But in order to maintain the proper phase relationship, the amplified output of port 6 of the present invention acting as a splitter must be directed to port 10 of the present invention acting as a combiner. Also, the amplified output of port 10 acting as a splitter must be directed to port 6 of the splitter acting as a combiner.

It will be appreciated the present invention can take many forms and embodiments. The true essence and spirit of this invention are defined in the appended claims, and it is not intended that the embodiment of the invention presented herein should limit the scope thereof. Transmission lines T1 through T12, for example, may be implemented in stripline, airline, microstrip, or other ways.

What is claimed is:

1. An apparatus for splitting an RF signal into four equal outputs and establishing a ninety degree phase relationship among said four equal parts, comprising:

means for splitting an input signal into four output signals; and means for establishing a ninety degree phase relationship among the four output signals;

wherein said means for establishing a ninety degree phase relationship among said four output signals, accepts inputs of relative equal amplitude with relative phase delays of approximately −90°, 37.8°, −132.6°, and −90° and produces outputs with relative equal amplitude and relative phase delays of approximately 180°, 90°, −90°, and 180°.

2. The apparatus of claim 1 wherein said means for establishing a ninety degree relationship among said four part output signals, accepts a signal of approximately −90° relative delay at one port and outputs a signal of 180° relative delay at a second port; accepts a signal of approximately 37.8° relative delay at a third port and outputs a signal of approximately 90° delay at a fourth port; accepts a signal of approximately −132.6° relative delay at a fifth port and outputs a signal of approximately −90° relative delay at a sixth port; and accepts a signal of approximately −90° relative delay at a seventh port and outputs a signal of approximately 180° relative delay at an eighth port.

3. The apparatus of claim 2 wherein said said first port of said means for establishing a ninety degree relationship is operatively connected to a transmission line of 180° electrical length, the output of which is connected to an input of a 3 db 90° coupler; another input of said coupler being connected to an input of a second transmission line of 90° electrical length which is unterminated at its output; a 90° output of said coupler connected to an input of a transmission line of 90° electrical length, the output of which is unterminated; the 0° output of said coupler constituting a 180° output of said means for splitting an RF signal.

4. The apparatus of claim 2 wherein said third port of said means for establishing a ninety degree phase relationship is operatively connected to a transmission line of 37.8° electrical length, the output of which is connected to an input of a 3 db 90° coupler; another input of said coupler being connected to an input of a second transmission line of 90° electrical length which is unterminated at its output; a 90° output of said coupler connected to an input of a transmission line of 90° electrical length, the output of which is unterminated; the 0° output of said coupler constituting a 90° output of said means for splitting an RF signal.

5. The apparatus of claim 2 wherein said third port of said means for establishing a ninety degree relationship is operatively connected to a transmission line of 47.4° electrical length, the output of which is connected to an input of a 3 db 90° coupler; another input of said coupler being connected to an input of a selected transmission line of 90° electrical length which is unterminated at its output; a 90° of said coupler connected to an input of a transmission line of 90° electrical length, the output of which is unterminated; the 0° output of said coupler constituting a −90° output of said means for splitting an RF signal.

6. The apparatus of claim 2 wherein said seventh port of said means for establishing a ninety degree relationship is operatively connected to a transmission line of 180° electrical length, the output of which is connected to an input of a 3 db 90° coupler; another input of said coupler being connected to an input of a second transmission line of 90° electrical length which is unterminated at its output; a 90 ° output of said coupler connected to an input of a transmission line of 90° electrical length, the output of which is unterminated; the 0° output of said coupler constituting a 180° output of said means for splitting an RF signal.

7. A method of dividing an RF input signal into four signals of equal power and having a ninety degree phase relationship, comprising:

dividing the input signal into four approximately equal parts;

correcting the power amplitude errors of the four parts;

delaying the four parts an amount required to establish a ninety degree relationship among the four parts;

maintaining the ninety degree phase relationship of the four parts;

wherein the step of dividing the input signal into four parts includes dividing the input signal into two signals of approximately 50 percent of the power amplitude of the input signal, the two signals being complementarily variable above and below 50 percent of input signal power then dividing each of the resultant signals into two parts with two of the four resultant signals containing approximately 25 percent of the power amplitude of the input signal and the remaining resultant signals being complementarily variable above and below 25 percent of the input signal power;

wherein the step of correcting the power amplitude errors of the four parts of the input signal includes presenting the two complementarily variable ports of the divided signal to a circuit means which provides two outputs of 25 percent of the power of the available input power; and wherein the step of establishing a ninety degree phase relationship among the four parts of the input signal includes inserting delay network means in the path of the each of the four parts of the divided input signal so that each part is 90° out of phase with respect to one of the other parts.

8. A method of claim 7 wherein the step of maintaining the ninety degree phase relationship of the four parts of the input signal includes providing an equalization network means for each of the four parts of the input signal.

* * * * *